US005671824A

United States Patent [19]

Keegan et al.

[11] Patent Number: 5,671,824

[45] Date of Patent: Sep. 30, 1997

[54] VERTICALLY MOVABLE EMERGENCY EGRESS SYSTEM

[76] Inventors: E. Kevin Keegan, 26 Exford Pl., Albertson, N.Y. 11507; Peter J. Hanrahan, 1181 Broadway, Penthouse Suite, New York, N.Y. 10001

[21] Appl. No.: 340,641

[22] Filed: Nov. 16, 1994

[51] Int. Cl.[6] ..... B66B 9/00

[52] U.S. Cl. ..... 182/82; 182/142

[58] Field of Search ..... 182/82, 141, 142; 189/239, 349

[56] References Cited

U.S. PATENT DOCUMENTS

| | | | |
|---|---|---|---|
| 3,726,364 | 4/1973 | Citrin et al. . | |
| 3,773,145 | 11/1973 | Drexler . | |
| 3,788,428 | 1/1974 | Fried . | |
| 4,018,306 | 4/1977 | Lyons | 182/142 |
| 4,125,172 | 11/1978 | Hatala | 182/824 |
| 5,014,825 | 5/1991 | Suzuki . | |
| 5,392,877 | 2/1995 | Shahin | 182/82 |

*Primary Examiner*—Alvin C. Chin-Shue
*Attorney, Agent, or Firm*—Morgan & Finnegan LLP

[57] ABSTRACT

An emergency escape elevator features a release device for releasing the elevator from its tethering cable, allowing the elevator to descend under the force of gravity. A vertical descent control apparatus controls the rate of descent of the elevator by measuring the rate of descent of the elevator and applying a brake to keep the elevator falling at a desired safe rate. The elevator guiderails are tapered inward at the bottom of the elevator shaft to apply friction to the elevator to slow it down. The elevator shaft can turn at the bottom and become horizontal to aid in slowing and stopping the elevator.

19 Claims, 13 Drawing Sheets

FIG. 8C
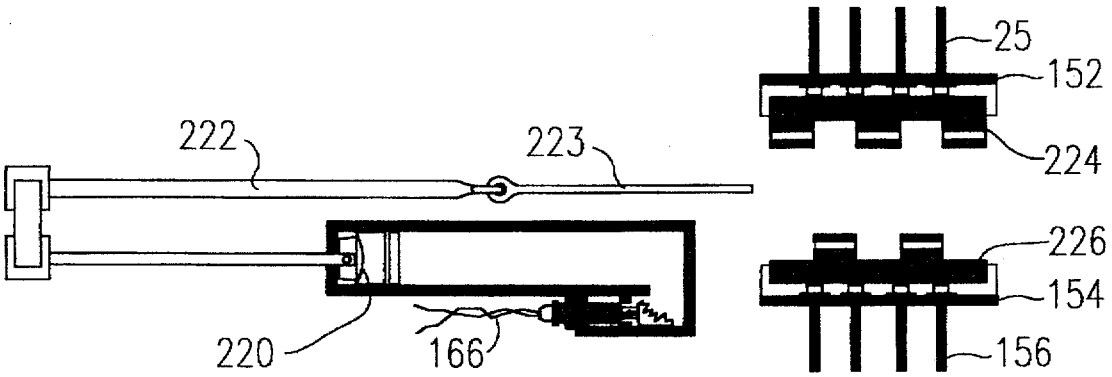
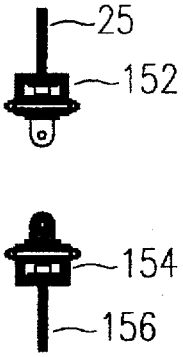
FIG. 8D

VERTICALLY MOVABLE EMERGENCY EGRESS SYSTEM

TECHNICAL FIELD OF THE INVENTION

This invention relates generally to elevators and more particularly, to an elevator permitting safe egress from a multiple story building during an emergency situation, such as in the event of fire, where usage of conventional elevators would otherwise not normally be a feasible nor an advisable course of action.

BACKGROUND OF THE INVENTION

In this age of high rise buildings, safe egress during emergency situations is a primary concern of modern day building design. Providing safe egress for disabled occupants of high rise buildings is especially important and often difficult.

Historically it is said that, when in a multiple story building, one of the more dangerous places to be during a fire or other emergency is an elevator. For example, in the event of fire the elevator can be rendered immobile due to the loss of electrical power, dangerously trapping any occupants inside. Electrical power can be lost quickly since, e.g., the fire department may turn the power off to prevent the possible electrocution of fire fighters or persons still in the building. Power can also be suddenly lost due to fire damage to the building's power distribution system. The severity of the danger associated with being trapped in an elevator in an emergency is magnified due to the dangers posed by both fire and smoke. Smoke and/or fire may draft up the elevator shaft creating an extremely dangerous situation for any occupants stranded in the immobile elevator.

Accordingly, the usual method of emergency egress currently available in such buildings is access to an escape floor by stairway. For example, FIG. 1 shows a cross-sectional view of a typical building having a number of floors, one of which is an escape floor 5, i.e., the floor that provides safe escape from the building. An elevator 10 is suspended by a cable 12 which allows the elevator to move vertically to any floor. If an emergency occurs, occupants of the building must access a stairway 14 and walk down to the escape floor. While this is somewhat of a burden on occupants of higher floors, it can be impossible for those occupants who are disabled. Furthermore, stairways can become filled with smoke in a fire and may therefore be impassable, even for the most fit occupant.

SUMMARY OF THE INVENTION

The disadvantages of the prior art are overcome by the present invention which features an elevator that can descend to an escape floor in a controlled manner using the force of gravity as its power source. The controlled descent is achieved using a vertical descent control apparatus that enables the unpowered elevator to descend at a predetermined safe rate. The invention also features a number of ways of controlling the descent of the unpowered elevator to prevent a faster than desired descent. Although the features of the invention find particular utility in the field of elevators, the invention can be used in other fields.

In one aspect, the invention features an emergency escape apparatus for transporting passengers to a lower elevation in the event of an emergency situation, the apparatus including an enclosure for holding the passengers, the enclosure being vertically movable by a driving mechanism, and a release mechanism for releasing the enclosure from the control of the driving mechanism to allow the enclosure to descend under the force of gravity.

In preferred embodiments, the emergency escape apparatus utilizes a descent control mechanism for controlling the rate of descent of the enclosure after the release mechanism has released the enclosure from the driving mechanism. The enclosure is preferably freely vertically movable along a guiding beam that restricts horizontal movement of the enclosure. The descent control mechanism may include a brake that engages the guiding beam. The descent control mechanism may further comprise a speed detecting device to detect the rate at which the enclosure is descending. A control device controls the application of the brake in accordance with an output signal received from the speed detecting device to maintain the rate of descent of the enclosure at approximately a predetermined safe descent rate.

The driving mechanism can be a cable attached to the enclosure and a motor for raising and lowering the cable to thereby raise and lower the enclosure. The release mechanism can include a first support bracket connected to the cable and a second support bracket connected to the enclosure, with an explosive bolt joining the first bracket to the second bracket such that when the explosive bolt is detonated the first and second brackets are separated.

In another aspect, the invention features an emergency escape elevator for lowering passengers in a multistory building to an escape floor in the event of an emergency situation, the elevator including an elevator cab for holding the passengers, a cable having a first end attached to the cab and a second end attached to a counterweight, a driving mechanism including a motor for vertically moving the cab by raising and lowering the cable, and a release mechanism for releasing the cab from the cable to allow the enclosure to descend under the force of gravity.

In yet another aspect, the invention features a passenger vehicle including a passenger transporting structure movable along a predetermined path to transport passengers along the path, and a stationary braking rail positioned in at least one portion of the path at a predetermined distance from a surface of the structure, the predetermined distance decreasing as the vehicle moves along the portion of the path such that the braking rail comes into contact with the surface to thereby apply a frictional force to the surface.

The braking rail can have a first section extending along the one portion of the path and a second section extending along a second portion of the path, with the predetermined distance in the second portion being approximately constant.

In preferred embodiments, a second stationary braking rail is positioned in the at least one portion of the path at a second predetermined distance from a second surface of the structure, wherein the second predetermined distance decreases as the vehicle moves along the portion of the path such that the second braking rail comes into contact with the second surface to thereby apply a frictional force to the second surface.

In a still further aspect, the invention features a vertically movable passenger vehicle including a passenger transporting structure vertically movable along a predetermined path to transport passengers along the path, and a guiderail positioned in the path at a predetermined distance from a surface of the structure, wherein the guiderail includes a first section where the predetermined distance is constant and a second section where the predetermined distance decreases as the structure descends, the guiderail eventually contacting and applying a frictional force to the surface to reduce the rate of descent of the structure.

In yet another aspect, the invention comprises an elevator including: an elevator cab movable along a predetermined path; an elevator shaft within which the cab moves; and a guiderail positioned in the elevator shaft to guide the path of the cab along a predetermined route within the shaft; wherein the elevator shaft comprises a vertical portion connecting a number of spaced floors, the elevator providing access to each of the floors for loading and unloading passengers at each of the floors; and wherein the elevator shaft further comprises a substantially horizontal section connected to the vertical section by a curved section such that an elevator descending through the vertical section will pass through the curved section and enter the horizontal section.

Thus, the invention allows safe emergency operation of an elevator when connection to an external power source is not possible. The invention provides a safe method of egress for disabled occupants and also to others who may have been inside the elevator when the emergency occurred or who access the elevator because other emergency routes of escape are undesirable.

The foregoing and other features and advantages of the present invention will become more apparent in light of the following detailed description of exemplary embodiments thereof, as illustrated in the accompanying drawings.

BRIEF DESCRIPTION OF DRAWINGS

FIG. 8C is a cross-sectional side view of the elevator release mechanism shown in FIG. 8A after release.

FIG. 8D is a cross-sectional side view of the elevator release mechanism of FIG. 8C.

DETAILED DESCRIPTION OF THE PREFERRED EMBODIMENTS

Figure 1:
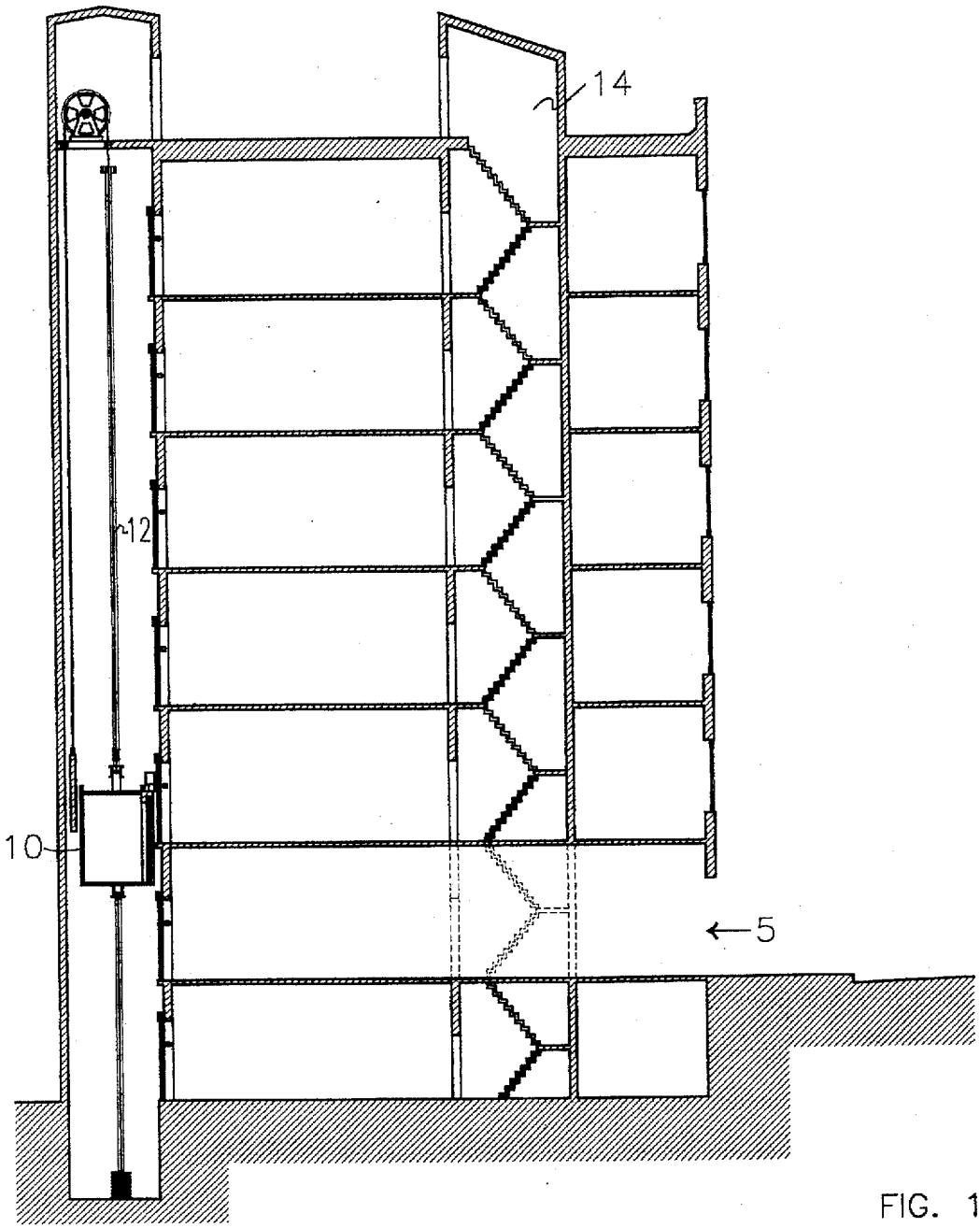
FIG. 1 is a cross-sectional view of a conventional elevator system situated in a multistory building.
Figure 2:
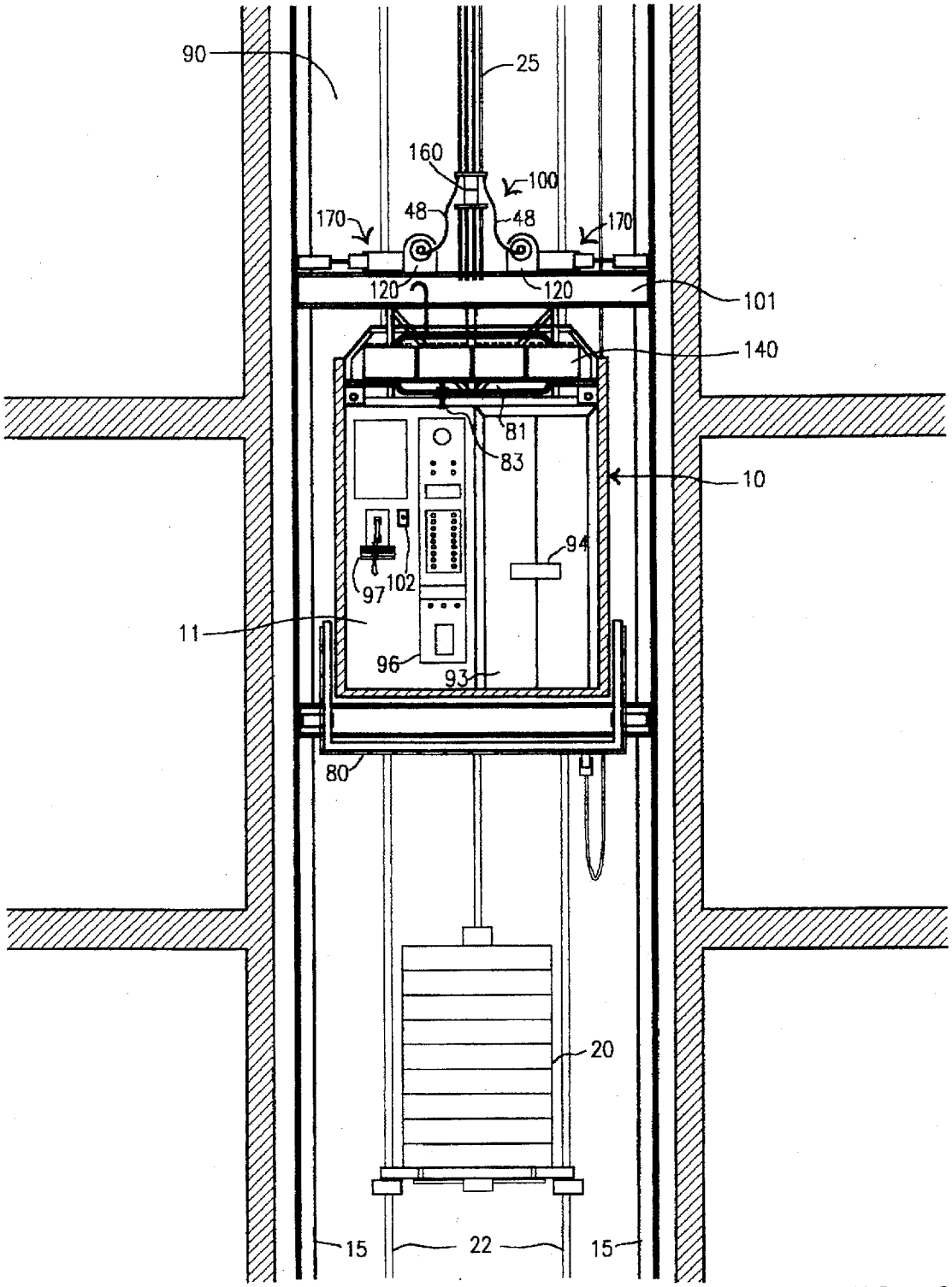
FIG. 2 is a cross-sectional view of an elevator structure according to one embodiment of the present invention.

A first embodiment of an emergency escape elevator system according to the invention is shown in FIG. 2 and includes an elevator cab 10, an interior cab space 11 to accommodate passengers, elevator guiderails 15, elevator counterweight 20, counterweight guiderails 22, tethering cables 25, Vertical Descent Control Apparatus (hereinafter 'VDCA') 100, and elevator shaft 90. The interior of cab 10 includes a standard elevator control panel 96, a telephone 97, and a safety door latch 94 on automatic elevator door 93. Also shown in cab 10 is an activation switch 102 which activates the VDCA 100, as described further below.

The elevator according to the present invention is equipped with a heat shield 80, formed with available insulating the or other appropriate material to protect from heat, smoke and or flames. Also, a water tank 81 is secured on top of cab 10 and contains water that can be used in the event of a fire within space 11. A sprinkler head 83 draws water from tank 81 and sprays interior space 11.

The VDCA 100, as shown in FIG. 2, includes an elevator release mechanism 160 which is fastened to elevator support cable 25 on its upper end and to elevator support beams 101 on its lower end. Activation switch 102 activates the elevator release mechanism 160 as described below.

Also shown in FIG. 2, and described in more detail below, are other components of VDCA 100, including braking mechanisms 170, air compressors 120 and cables 48 connected between each compressor 120 and elevator support cables 25.

The configuration of elevator release mechanism 160 is depicted in greater detail in FIGS. 3A through 3D, and includes upper and lower support brackets 152 and 154, respectively. Upper bracket 152 is attached to the elevator's tether cables 25 and to cables 162. The lower bracket 154 is attached to the elevator cab 10 via securing cables 156.

Figure 3A:
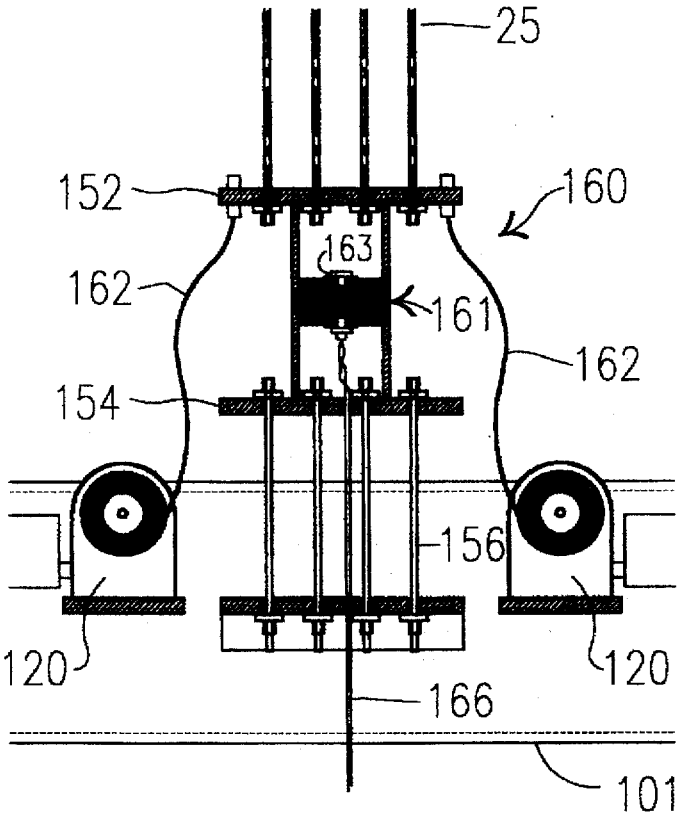
FIG. 3A is a larger cross-sectional view of an elevator release mechanism shown in FIG. 1.
Figure 3B:
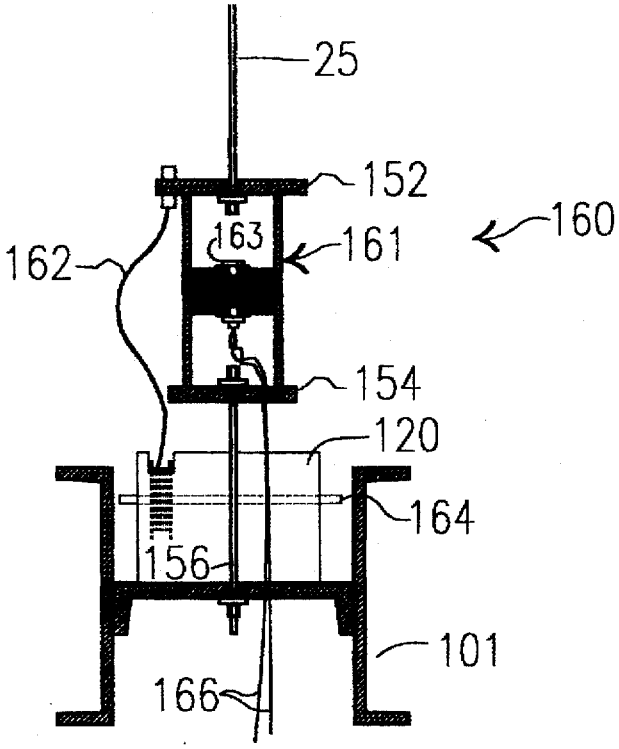
FIG. 3B is cross-sectional side view of the elevator release mechanism of FIG. 3A.
Figure 3C:
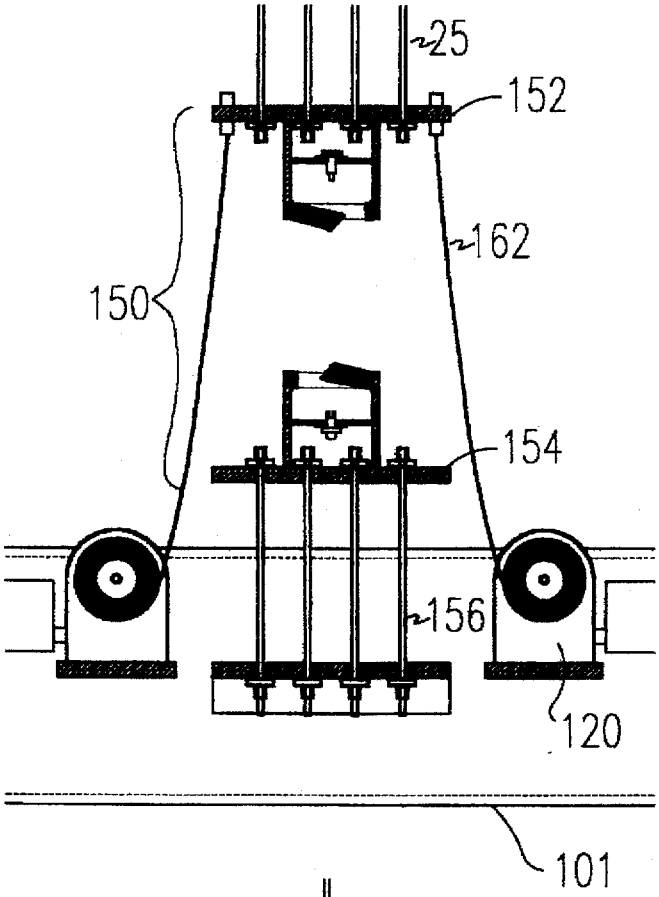
FIG. 3C is a cross-sectional view of the elevator release mechanism of FIG. 3A after release.
Figure 3D:
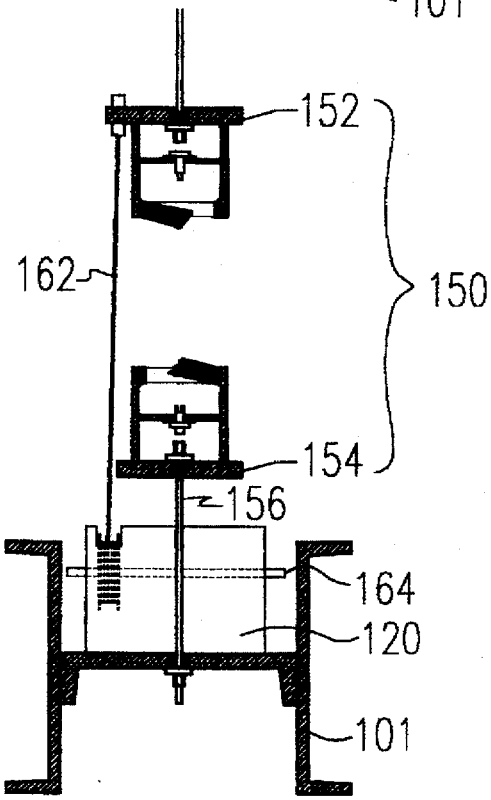
FIG. 3D is a cross-sectional side view of the elevator release mechanism of FIG. 3C.

The upper and lower brackets 152, 154 of the release mechanism 160 are joined together by a release assembly 161 that includes an explosive bolt 163. Electrical leads 166 from the explosive bolt 163 are electrically connected to the activation switch 102 in the interior of the elevator cab structure 10. As noted above, FIG. 3B is a side view of the device shown in FIG. 3A and FIG. 3D is a side view of the device of FIG. 3C. FIGS. 3A and 3B show the release mechanism in a condition before release. FIGS. 3C and 3D show the release mechanism after the elevator release mechanism 160 has been activated, i.e., after explosive bolt 163 has been fired.

Air compressors 120 are each driven by one of cables 162 spooled on a compressor drive shaft pulley 164 (see FIGS. 3B and 3D). When a cable 162 is pulled from the pulley 164 (after release), the compressor 120 is driven to compress air and fill an air reservoir. Standard bleed-off and regulator valves as required are implemented as is known in the industry to maintain safe and constant air pressure in the reservoir. The reservoir is initially filled with compressed air as a redundant safety feature, so that in the event of failure in the compressor 120 or other component that would prevent proper compressor operation, the reservoir has an initial charge to operate the VDCA 100.

Figure 4:
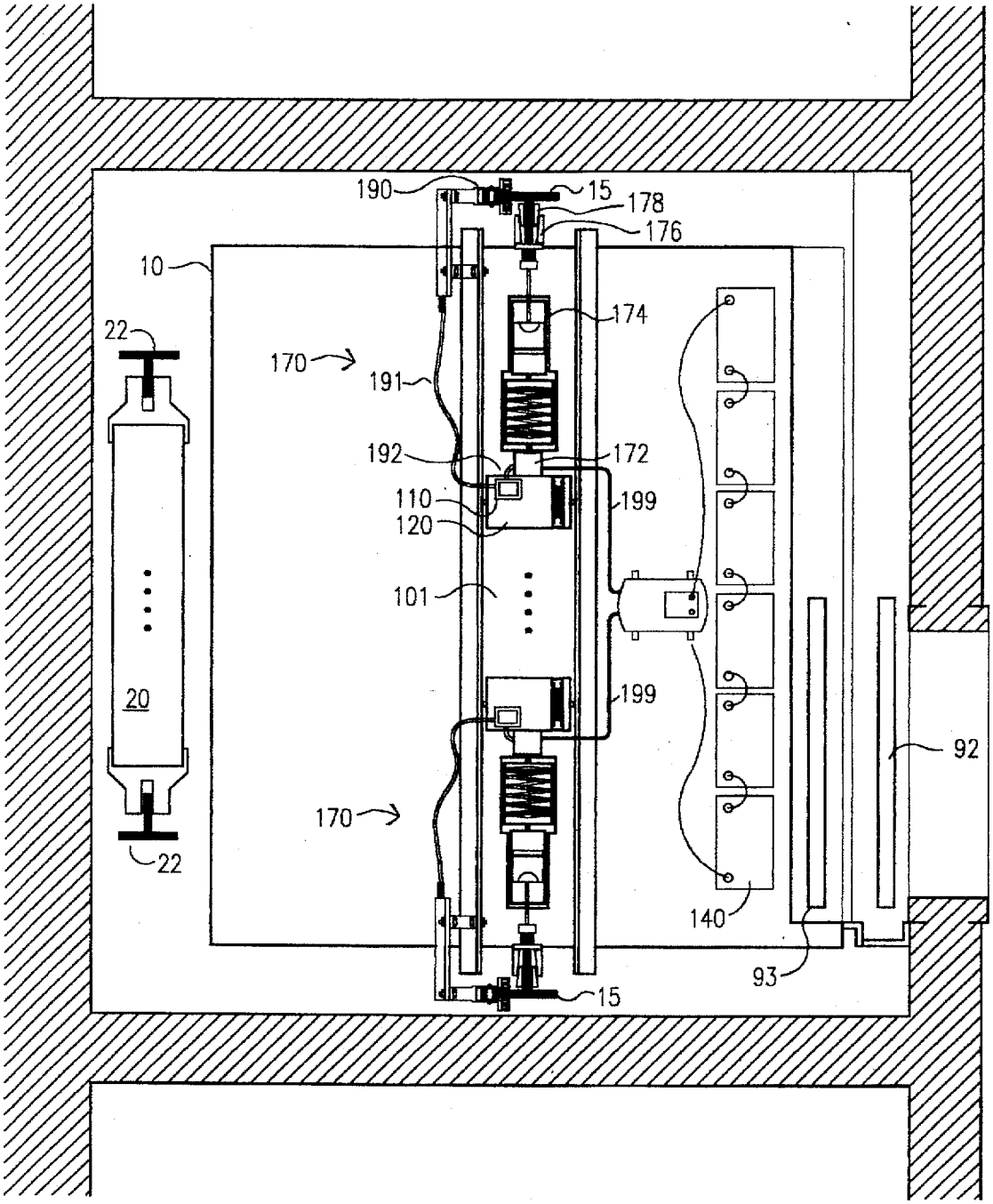
FIG. 4 is a cross-sectional top view of the elevator and the vertical descent control apparatus of FIGS. 2–3.
Figure 5:
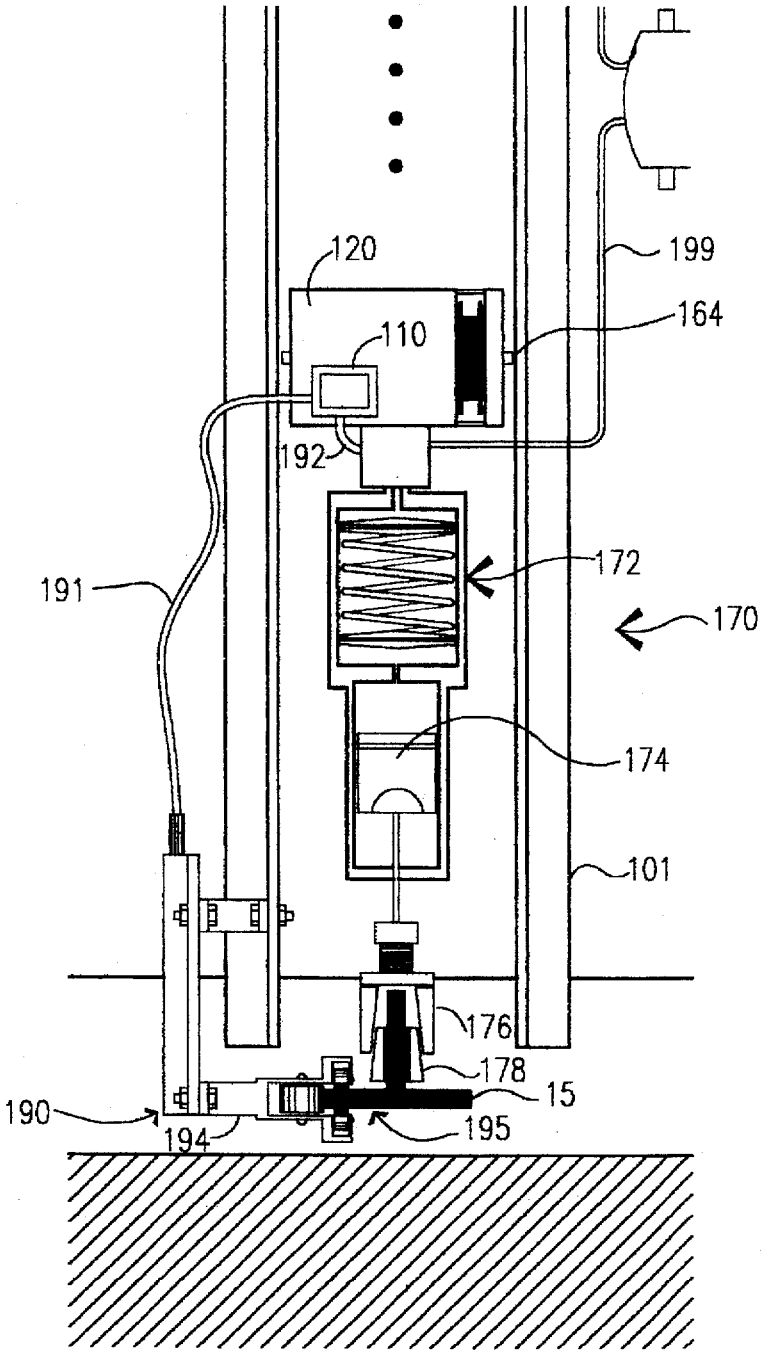
FIG. 5 is a larger cross-sectional view of one vertical descent control apparatus shown in FIG. 4.

As is shown in FIGS. 4 and 5, each of the two braking mechanisms 170 includes a mechanical actuator 172, powered by compressed air from compressor 120 and controlled by the VDCA microcontroller 110. The extension of a power piston 174 of the actuator 172 causes a first movable surface 176 to engage a corresponding, complementary shaped second fixed surface 178 on the elevator guiderail 15, while retraction of the power piston 174 causes disengagement, extension and retraction occurring as commanded by the VDCA microcontroller 110. Operating as any braking system does, appropriate materials as are known in the art may be used for the two braking surfaces 176, 178 to allow friction between the two braking surfaces 176, 178, when engaged, to cause the decent of elevator 10 to be slowed.

A speed sensing device 190 comprises a sensing portion 194, which in the preferred embodiment are rotational pickups, attached to the elevator cab 10 and a fixed portion which can either be attached to the guiderails 15 or can be the guiderails 15 themselves, as in the preferred embodiment. The sensing portion 194 detects motion relative to the guiderails 15, such motion representing and being proportional to the motion of the elevator structure 10. The sensing portion 194 produces a velocity signal, representative of the detected motion, along input line 191 to the VDCA microcontroller 110. Speed sensing device 190 is a conventional mechanical speedometer although any other known, appropriate speed sensing mechanism, such as an optical speed sensor, may be utilized without compromising or altering the performance of the VDCA.

Independent power supply 140 (see FIG. 4) is mounted on the roof of the elevator structure 10 and is connected via electrical lines 199 so as to deliver electrical power on demand to the VDCA microcontroller 110, elevator release mechanism 160 (see FIGS. 3A and 3B), and to emergency lighting for the interior of the elevator cab structure 10. It should be readily understood by those skilled in the art that the type and placement of the batteries, as well as level of power supplied by the batteries, is not critical and need only be suitable to supply adequate operational power. Further, one skilled in the art should understand that a trickle charger, or similar device should be installed to keep the batteries charged to capacity during the course of normal elevator operation where they would otherwise remain unused and possibly discharge over time.

In an emergency situation, the activation switch (see FIG. 2) causes power from the independent power supply 140 to be applied to the two VDCA microcontrollers 10 via leads 199, as well as to energize the elevator release mechanism 160 via electrical leads 166 causing the explosive bolt to explode. This allows the upper and lower portions 152, 154 of the release mechanism 160 to come apart, allowing the elevator 10 to begin moving downward under the force of gravity. The activation switch 102 is manually actuated by passengers in the elevator cab compartment 11.

When the elevator structure 10 begins to fall, cables 162 spooled on each of the compressor shafts 164 remain attached to the upper portion 152 of the release mechanism which remains attached to tether cable 25. Thus, as the elevator structure 10 falls, cables 162 are pulled from their respective spools on each compressor shaft 164 thereby driving each compressor shaft 164 and causing each compressor to operate and compress air.

As described, actuation of switch 102 causes the VDCA microcontroller 110 to become powered and operational, and the VDCA microcontroller 110 immediately begins to control the rate of descent of the falling elevator structure 10.

Referring again to FIGS. 4 and 5, microcontroller 110 of VDCA 100 is a digital microcontroller device, utilizing closed loop feedback control technology. Such control technology regulates an object by controlling that object, via a digital microcontroller, to a determined target parameter. In simple control applications, a microcontroller receives an input signal, which provides the parameter to be controlled, and outputs a command signal to a mechanism to control the object about that parameter.

In the preferred embodiment, VDCA microcontroller 110 receives an input signal from the speed sensing device 190 along input line 191, indicating the rate of descent of the falling elevator structure 10, the rate of descent being the parameter to be controlled. The VDCA microcontroller 110 is preset to control the elevator structure 10 to a predetermined target rate of descent.

The VDCA microcontroller 110 will apply standard closed loop feedback control methodology to process the input signal (input on line 191), derive and output appropriate commands on output line 192 to the braking mechanism 170. Thus, the VDCA microcontroller 110, via commands output on output line 192, will actuate the braking mechanism 170 to either cause the braking surfaces 176, 178 to engage (or to engage more firmly) to slow down the falling elevator 10 or to disengage to allow the elevator 10 to increase its rate of descent. The VDCA microcontroller 10 will continuously receive the input signal on input line 191 and adjust the command signal it outputs on output line 192 to the braking mechanism 170 so as to maintain the target rate of descent. In standard control technology, this is referred to as loop closure.

Figure 6:
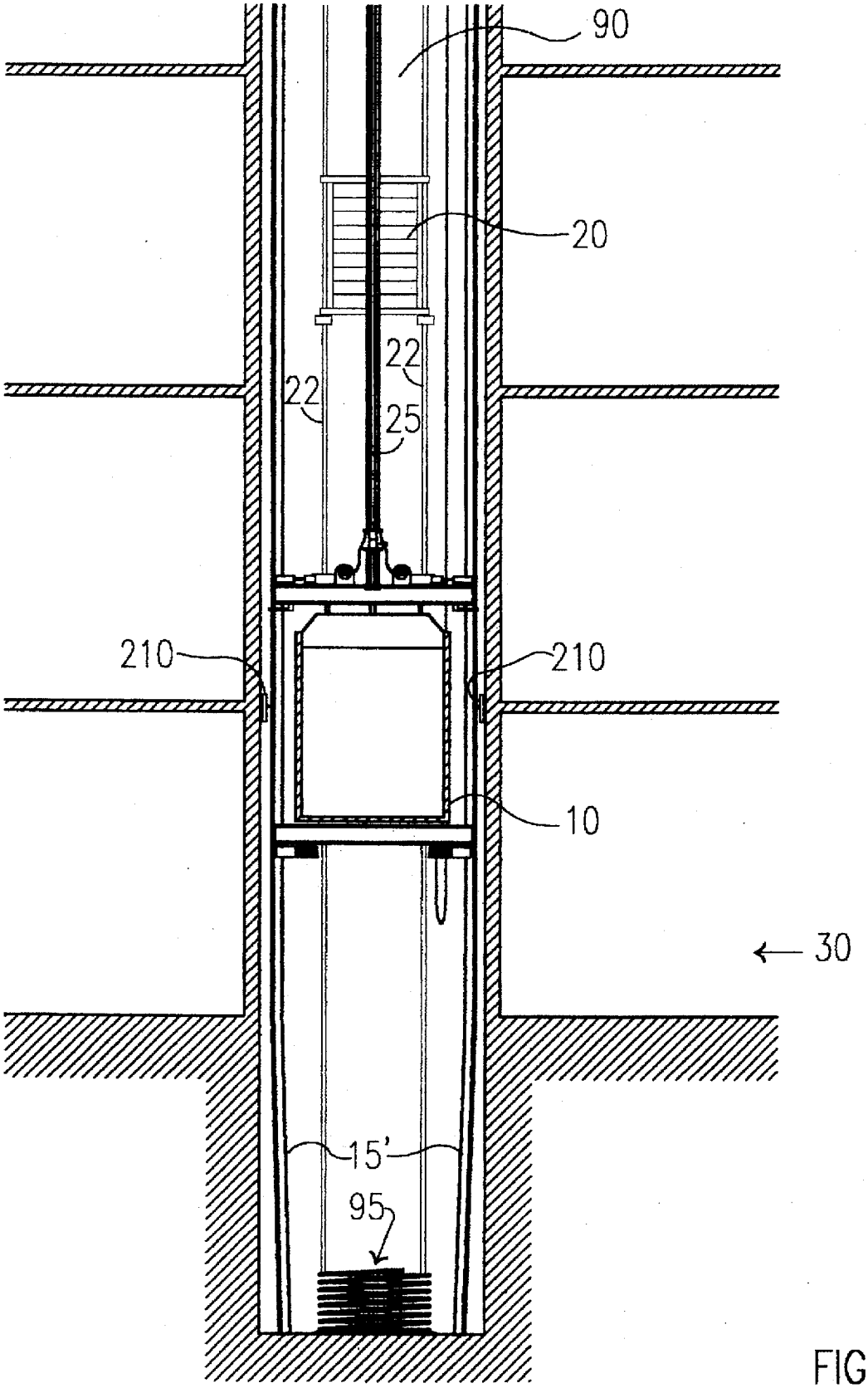
FIG. 6 is a cross-sectional view of the emergency escape elevator shown in FIGS. 2–5 and includes a view of the elevator shaft.

Maintaining a constant, but safe, rate of descent in the fashion just described, the elevator structure 10 will continue to descend until it approaches the escape floor 30 (as shown in FIG. 6), which can be any floor designated as such that will provide safe egress, e.g., the garage, the basement, the first floor, etc.

It should be noted that there will be other cables attached to elevator structure 10 in addition to tethering cables 25, such as power cables, telephone lines, etc. These cables can also be disengaged when explosive bolt 163 is activated. Alternatively, these cables can be disengaged by the force of the falling elevator.

As shown in FIG. 6, a trip switch 210 will be placed at a suitable distance from the escape floor 30 so that when the elevator 10 passes the trip switch 210, a signal will be sent to the VDCA microcontroller 10, whereby the target rate of descent will be scheduled toward zero and the VDCA microcontroller 110 will begin to command the braking mechanism 170 to bring the elevator to a complete stop at the escape floor 30. The elevator doors will then open, and the escape floor elevator doors are opened to permit the passengers to escape. A separate battery power supply may be needed to power the escape floor elevator doors.

Safety door latch 94 (see FIG. 2) is provided on the automatic elevator door 93 to prevent the elevator doors 93 from accidentally opening at a floor other than the escape floor 30. The safety door latch 94 can be manually latched from the inside of the elevator cab 10 or can be automatically engaged by the VDCA microcontroller 10 and released upon reaching the escape floor 30.

For increased safety of the occupants, the elevator cab 11 can be designed so as to provide an air tight seal upon closing the automatic elevator door 93 to prevent the entry of smoke or fumes that may be harmful to the occupants.

FIG. 6 illustrates a safety measure that can be incorporated into the elevator design to protect the elevator in the event of a failure of the elevator braking mechanism. The guiderails 15 along which the elevator 10 travels are tapered slightly inward toward the elevator body, effectively pinching the elevator body. Through the increasing friction caused by the pinching of the inclined guiderails 15', the elevator 10 will be brought to a safe stop.

The distance over which the guiderails are tapered is shown in FIG. 6 to be relatively short, but it may be desirable to increase this distance significantly such that the elevator is more gradually stopped. Also, the amount by which the rails are tapered is selected to gradually slow the elevator. This safety measure can be used apart from the emergency release mechanism described above and increases the safety of any elevator since elevator free fall is always a concern.

Another safety measure shown in FIG. 6 is a buffer 95, which may be a heavy duty spring-like device or other similar known device, located at the bottom of the elevator shaft 90 to aid in preventing a hard impact should the elevator 10 be descending at a higher-than-desired rate, again bringing the elevator to a safe stop.

In order to enhance the safe operation of the above described emergency escape elevator, certain actions should take place when the activation switch 102 is first engaged and before elevator release. First, if the elevator doors (interior and exterior) are not fully closed then they will be closed and locked at this time. An automatic emergency call is placed to police, fire and/or building security personnel. All of the elevator call buttons are deactivated for the elevator shaft concerned and all doors in the elevator shaft are locked.

Standard elevators include a machine room motor that functions to raise and lower the elevator during normal elevator operation. This motor should be locked to prevent further motion of cables 25. The counterweight includes brakes that should be engaged at this time to prevent the counterweight from falling after elevator release.

Standard elevators also include a speed governor that monitors elevator speed and engages the elevator emergency brakes if a predetermined speed is exceeded. This system should be disabled or adjusted prior to elevator release since the elevator may reach speeds during the emergency descent that are above the predetermined speed for break activation. If the system is not adjusted, the emergency brakes could be activated, trapping the occupants. The preferred adjustment is to raise the predetermined speed for brake activation. Such an adjustment retains the benefits associated with prevention of free fall and avoids unintentional activation of the brakes.

As noted above, all elevator electronics and electric cables etc. must be released before or during elevator release. If the power is not already shut off, then the power to the elevator shaft should be disconnected to prevent the hazards caused by live cables in the shaft.

Figure 7:
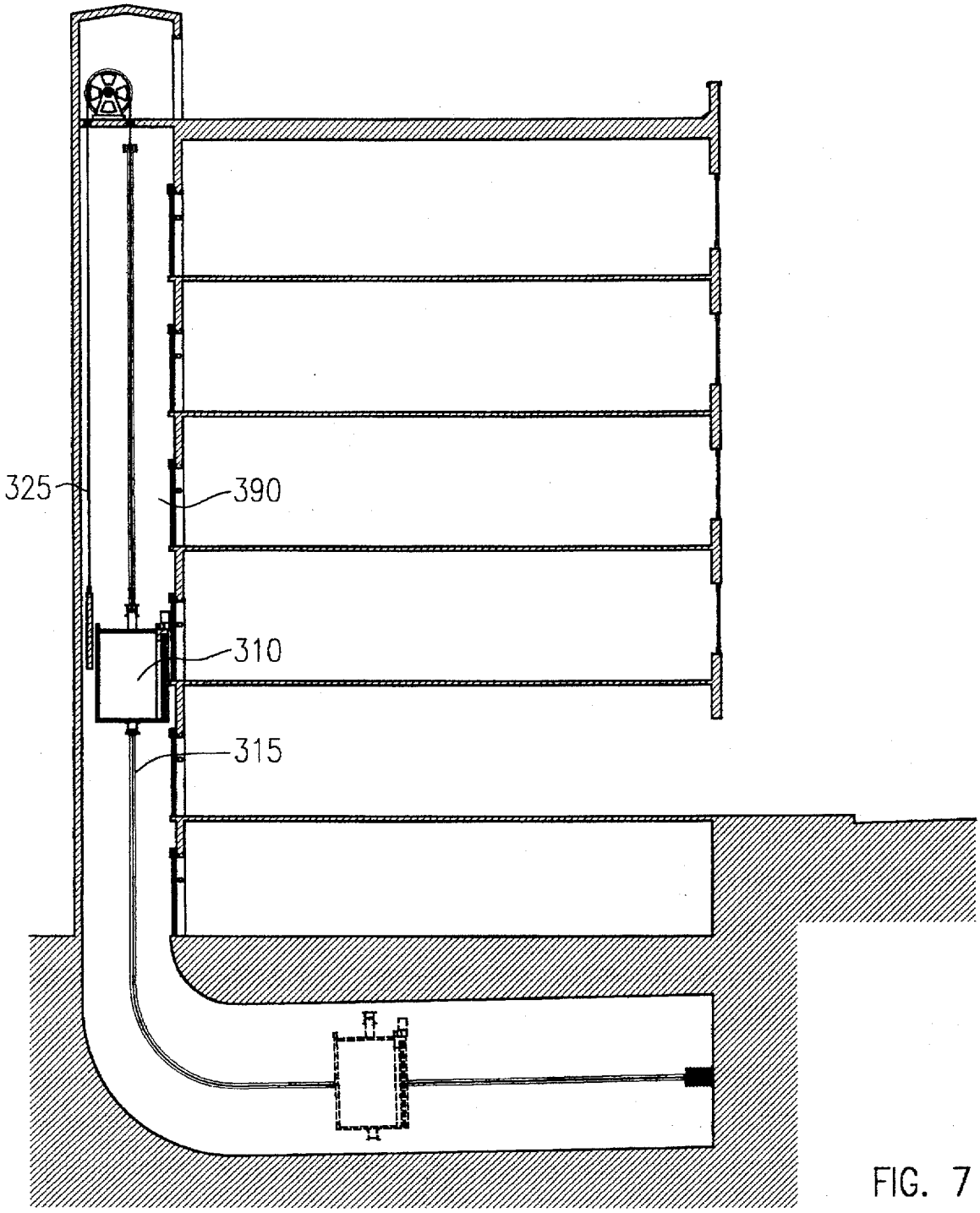
FIG. 7 is a cross-sectional view of an elevator and elevator shaft according to a second embodiment of the invention.

A second embodiment of an emergency escape elevator according to the present invention is illustrated in FIG. 7 and includes an elevator cab 310 suspended by a cable 325 and travelling in an elevator shaft 390. At the bottom of elevator shaft 390, the shaft turns approximately 90° in a gradual curved manner and then extends horizontally for some distance. An elevator guiderail 315 guides the elevator's path, and causes the elevator to make the turn as illustrated.

In the event of an elevator descending at a faster than desired rate, the curved elevator shaft will cause the elevator's vertical momentum to be translated to horizontal momentum, more easily enabling the braking mechanism to bring the elevator to a complete stop. Even the friction of the elevator on the guiderail can be enough to stop a horizontally traveling elevator. This feature can be used with the elevator VDCA described above or can be used independently to protect any elector from sudden stops after a fast vertical descent.

The angle of curvature shown in FIG. 7 can be adjusted such that the change from vertical to horizontal is more gradual. As will be known to those skilled in the art, the more sudden the turn to horizontal, the lower the maximum safe speed at which the turn can be made.

Figure 8A:
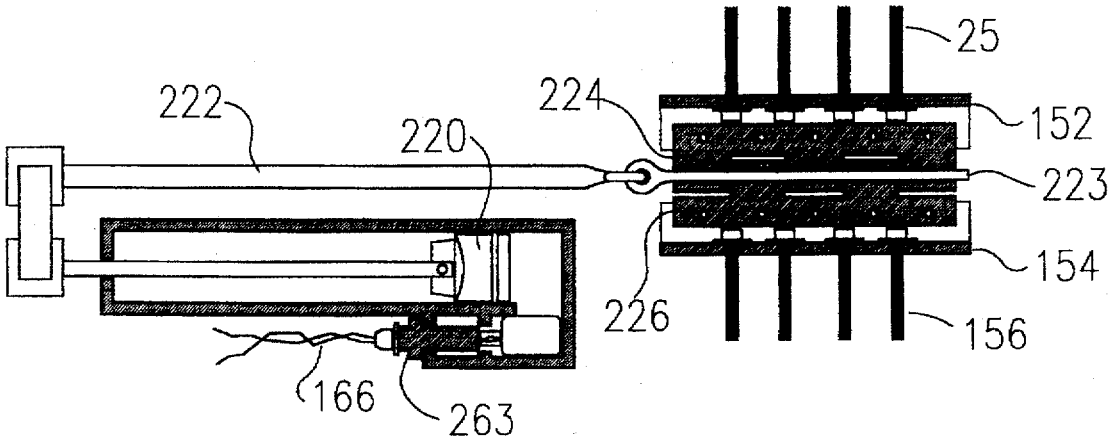
FIG. 8A is a cross-sectional view of a second embodiment of an elevator release mechanism.
Figure 8B:
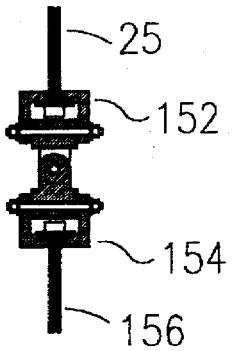
FIG. 8B is a cross-sectional side view of the elevator release mechanism shown in FIG. 8A.

An alternative embodiment to the elevator release mechanism employs a linkpin device and is depicted in FIGS. 8A–D. FIGS. 8A and 8B show the elevator release mechanism prior to release, 8B being a profile view, and FIGS. 8C and 8D show the elevator release mechanism after release, 8D being a profile view).

When explosive bolt 263 is activated using leads 166, the explosive force causes plunger 220 to move rapidly to the left in FIG. 8A, thereby pulling on arm 222. Arm 222 is connected to pin 223, which, before activation of bolt 263, secures upper bracket 224 to lower bracket 216. After detonation of bolt 166, however, pin 223 is pulled free of brackets 224, 226 as shown in FIGS. 8C and 8D.

Figure 9A:
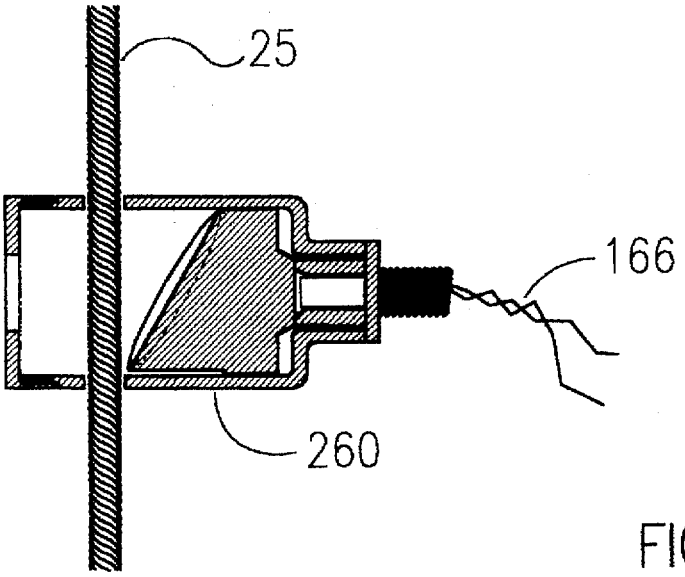
FIG. 9A is cross-sectional view of another embodiment of an elevator release mechanism.
Figure 9B:
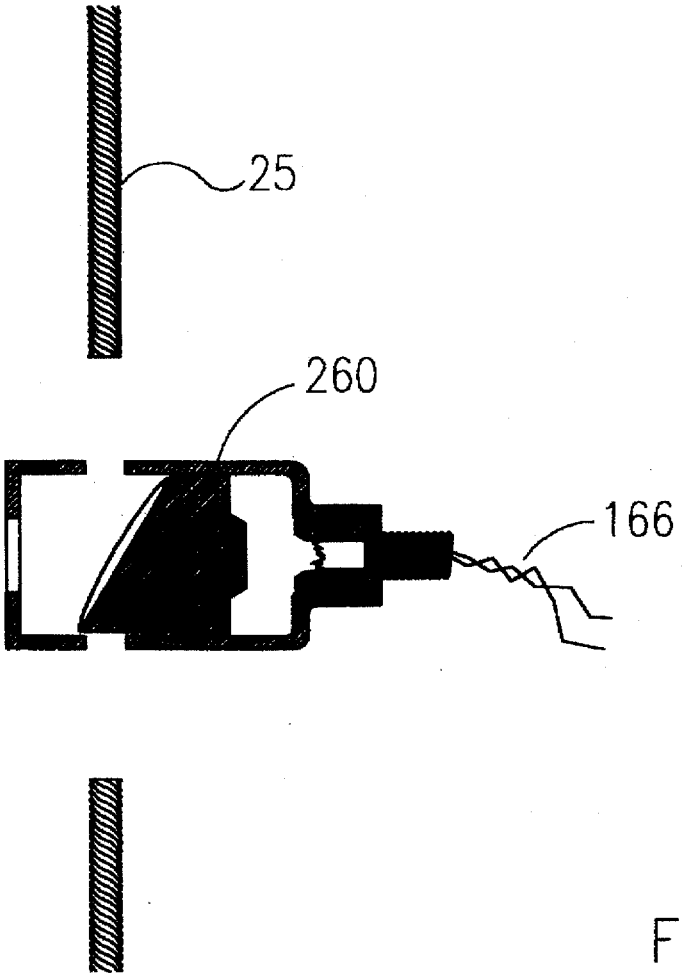
FIG. 9B is a cross-sectional view of the elevator release mechanism of FIG. 9A, after release.

Yet another embodiment of an emergency release mechanism that can be utilized with the present invention includes a cable shear device 260 as depicted in FIGS. 9A and 9B. (FIG. 9A showing the elevator release mechanism prior to release, and FIG. 9B showing elevator release mechanism after release.) As with the embodiments described above, the cable shear device is fired in a standard fashion by an explosive charge triggered by the activation switch 102, through leads 166.

Figure 10:
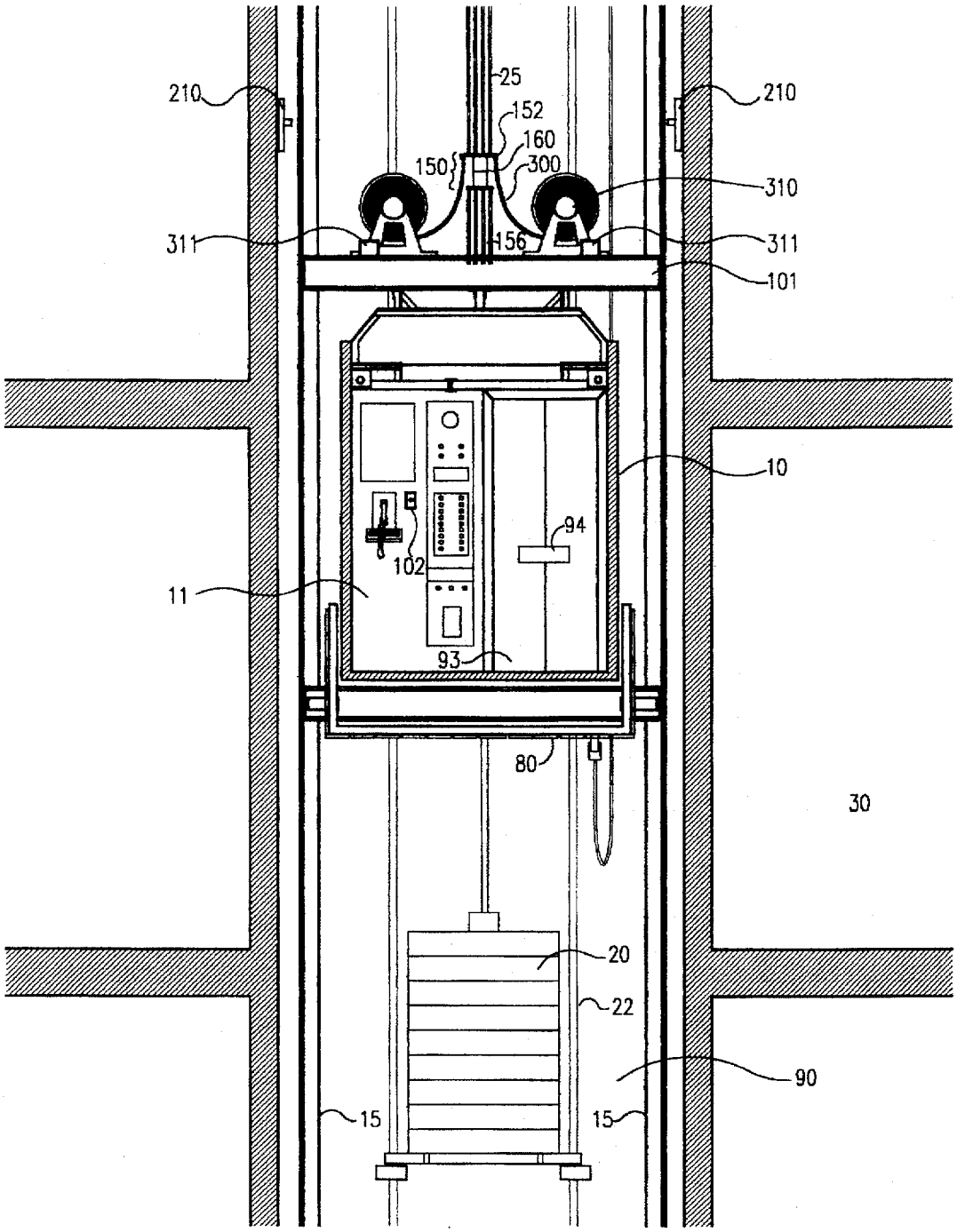
FIG. 10 is a cross-sectional view of an alternative embodiment of the emergency escape elevator of the present invention.

Another alternative embodiment of the invention is illustrated in FIG. 10. This design replaces the braking action provided by the VDCA 100 as described above with a tensioning cable 300. The tensioning cable design utilizes a spooled cable secured to the elevator support beams 101. (This is in lieu of the compressor 120 and braking mechanism 170.) The activation switch 102 and elevator release mechanism 160 will function as described above. The tensioning cable 300 is wound on a clutched spool 310 with one end of the cable secured to the hub of the spool 310 and the other end secured to upper portion 152. Upon actuation of the activation switch 102, the elevator 10 begins its fall as described above, restrained to fall at a desired rate of descent by the tension exerted by the cable 300, whose pay-out is restrained by the clutching mechanism in the hub of the spool 310, such clutching mechanism being of a standard design. The clutched spool 310 can be a standard electronic clutch controlled by a microcontroller 311. The microcontroller 311 would operate in a similar fashion as described for the embodiment described above, including the use of a trip switch 210 to bring the elevator to a complete stop on the preferred escape floor 30.

As noted above in connection with FIG. 2, an elevator counterweight 20 is attached to the opposite end of elevator cables 25 to prevent the elevator's weight from causing the elevator to descend during normal generation. The counterweight "balances" the weight of the elevator. In yet another embodiment of the invention, the descent of the elevator can be controlled without having to disconnect the elevator cables. Instead, this embodiment reduces the weight of the elevator's counterweight such that the counterweight no longer balances the elevator, and the weight of the elevator and its passengers cause the elevator to descend.

Figure 11:
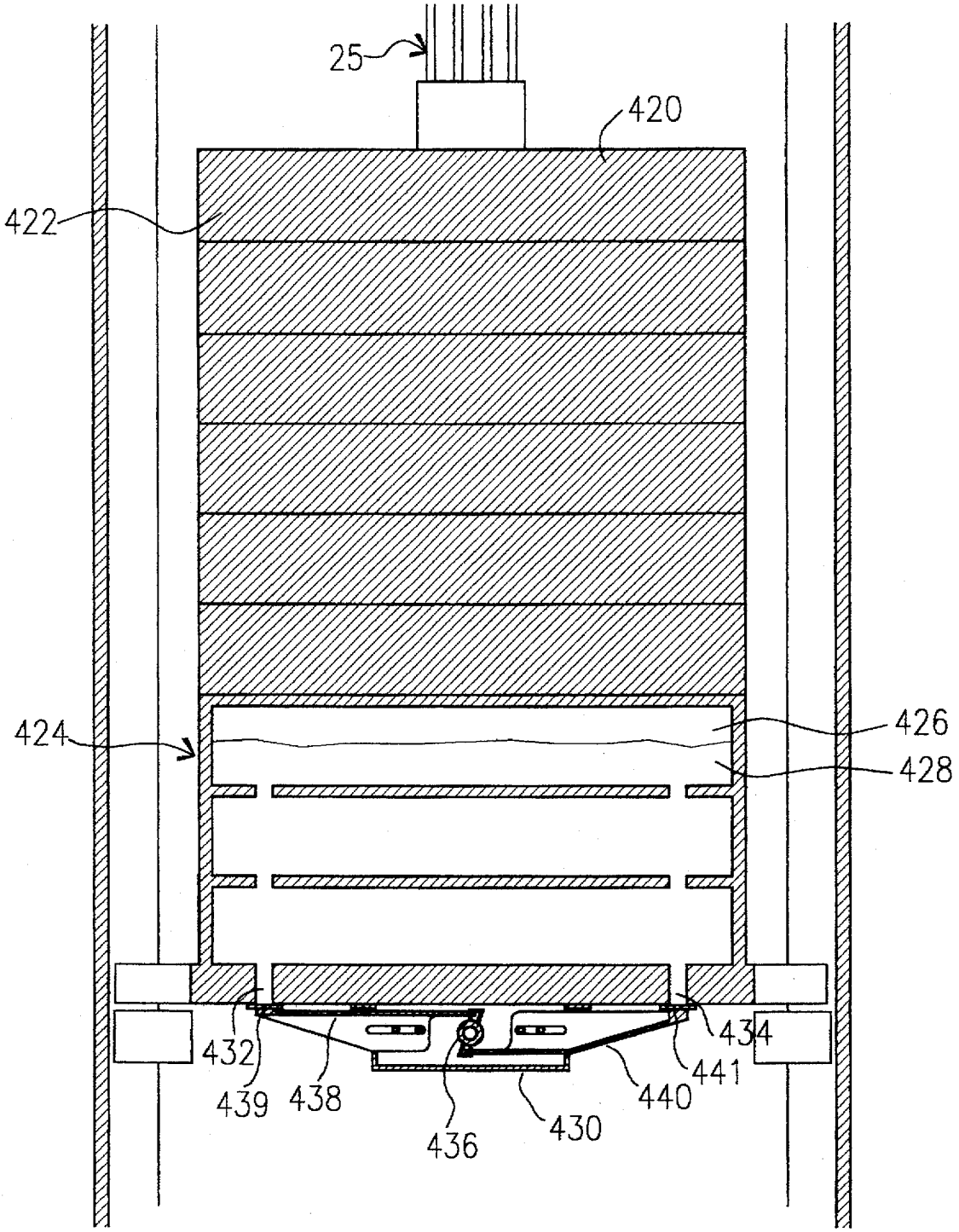
FIG. 11 is a cross-sectional view of an adjustable counterweight of an alternative embodiment of the present invention.

One embodiment for adjusting the weight of the counterweight is shown in FIG. 11, which illustrates counterweight 420 attached to elevator tethering cables 25. Counterweight 420 includes a number of standard solid weights 422 and a hollow weight section 424, including an internal hollow space 426. Space 426 is filled with sand 428. At the bottom of counterweight 420 is a release mechanism 430 which controls the release of sand 428 through two openings 432, 434 on the bottom surface of counterweight 420.

Release mechanism 430 includes a servo motor 436 that controls two laterally movable arms 438, 440. Arms 438, 440 include two mating surfaces 439, 441, respectively, that mate with openings 432 and 434 as shown. Servo motor 436 can operate to move arms 438, 440 laterally to pull mating surfaces 439, 440 away from openings 432, 434, to thereby permit sand 428 to pass out of hollow space 426 thereby reducing the weight of counterweight 420. Instead of sand, other materials could be used, such as water or other liquids.

Thus, in the embodiment of FIG. 11, when an emergency occurs, activation switch 102 is pressed by a passenger causing servo motor 436 to be activated to cause sand to begin to flow out of the counterweight. The falling sand will gradually reduce the weight of counterweight 420 causing the elevator cab to begin a slow descent toward the escape floor.

The size of the openings are chosen to control the rate of sand release to thereby control the rate of elevator descent. Alternatively, a closed loop feedback system, similar to that described above, can be used to control the rate of flow of sand, with servo motor 436 operative to start and stop sand release in response to the speed of the elevator.

The system of FIG. 11 can be used instead of, or in addition to, the features described above and illustrated in FIGS. 2–10.

Various additional safety features may be included in the emergency escape elevator described above. For example, activation switch 103 may be designed to be controllable from a predetermined remote location that is accessible, for example, by fire officials. Such a remote activation feature would allow a fire official to engage the VDCA to cause the elevator to descend to the lobby if power is otherwise unavailable. This could be particularly useful if the elevator passengers are incapacitated and unable to engage the system. The remote activation can be radio controlled in case normal communications channels to the elevator are unavailable.

The elevator can also include a standard emergency brake that is engagable from within the cab to stop the elevator quickly if the passengers suspect the elevator is descending at a rate that is unsafe. Further, the elevator can be programmed to ignore all calls to floors other than the escape floor to further prevent the elevator from opening at a floor that is not safe.

Since there may be a possibility of inadvertent or vandalistic activation of the system when no emergency exists, activation switch 102 can be disabled during normal elevator operation and can be activated only upon a certain condition, e.g., a power failure in the building or the engagement of a fire alarm, etc.

Conventional elevators can be modified or retrofit to incorporate the VDCA, and the other emergency and safety features of the present invention.

This invention has been illustrated and described with respect to specific exemplary embodiments. It is to be understood, however, that this invention is not limited by these illustrative descriptions and that many variations are possible. For example, although optimized for use in elevators to provide vertically movable emergency egress, the VDCA of the present invention may be used in other applications where it is desired to control the directional velocity of a body. Also, the other braking features, such as the tapered guiderails, may be used on horizontally moving passenger vehicles, such as trains. It should further be understood by one skilled in the art that the foregoing and various other changes, omissions and additions may be made without departing from the spirit and scope of the invention as defined by the appended claims.

We claim:

1. An emergency escape apparatus for transporting passengers to a lower elevation in the event of an emergency situation, said apparatus comprising:

an enclosure for holding said passengers, said enclosure being vertically movable upwardly and downwardly by a driving mechanism; and a release mechanism for releasing said enclosure from the control of the driving mechanism to allow said enclosure to descend under the force of gravity.

2. The emergency escape apparatus of claim 1, further comprising a descent control mechanism for controlling the rate of descent of said enclosure after said release mechanism has released said enclosure from the driving mechanism.

3. An emergency escape apparatus for transporting passengers to a lower elevation in the event of an emergency situation, said apparatus comprising:

an enclosure for holding said passengers, said enclosure being vertically movable by a driving mechanism;

a release mechanism for releasing said enclosure from the control of the driving mechanism to allow said enclosure to descend under the force of gravity; and a descent Control mechanism for controlling the rate of descent of said enclosure after said release mechanism has released said enclosure from the driving mechanism;

wherein said enclosure is freely vertically movable along a guiding beam and wherein said descent control mechanism comprises a brake that engages said guiding beam.

4. The emergency escape apparatus of claim 3, wherein said descent control mechanism further comprises a speed detecting device to detect the rate at which said enclosure is descending.

5. The emergency escape apparatus of claim 4, wherein said descent control mechanism further comprises a control device that controls the application of said brake in accordance with an output signal received from said speed detecting device to maintain the rate of descent of said enclosure at approximately a predetermined safe descent rate.

6. An emergency escape apparatus for transporting passengers to a lower elevation in the event of an emergency situation, said apparatus comprising:

an enclosure for holding said passengers, said enclosure being vertically movable by a driving mechanism; and a release mechanism for releasing said enclosure from the control of the driving mechanism to allow said enclosure to descend under the force of gravity;

wherein said driving mechanism comprises a cable attached to said enclosure and a motor for raising and lowering said cable to thereby raise and lower said enclosure.

7. The emergency escape apparatus of claim 6, wherein said release mechanism comprises means for detaching said cable from said enclosure.

8. The emergency escape apparatus of claim 6, wherein said release mechanism comprises an explosive bolt.

9. The emergency escape apparatus of claim 8, wherein said release mechanism further comprises a first support bracket connected to said cable and a second support bracket connected to said enclosure, said explosive bolt joining said first bracket to said second bracket such that when said explosive bolt is detonated said first and second brackets are separated.

10. The emergency escape apparatus of claim 1 wherein said enclosure is the cab of a passenger elevator.

11. An emergency escape apparatus for transporting passengers to a lower elevation in the event of an emergency situation, said apparatus comprising:

an enclosure for holding said passengers, said enclosure being vertically movable by a driving mechanism; and a release mechanism for releasing said enclosure from the control of the driving mechanism to allow said enclosure to descend under the force of gravity;

wherein said enclosure is freely vertically movable along a guiding beam, said guiding beam restricting horizontal movement of said enclosure.

12. An emergency escape apparatus for transporting passengers to a lower elevation in the event of an emergency situation, said apparatus comprising:

an enclosure for holding said passengers;

a driving mechanism including a motor for vertically moving said enclosure, said driving mechanism comprising a cable having a first end attached to said enclosure and a second end attached to a counterweight, said driving mechanism operative to move said cable; and a release mechanism for releasing said enclosure from the control of said driving mechanism by detaching said first end of said cable from said enclosure to allow said enclosure to descend under the force of gravity.

13. The emergency escape apparatus of claim 12, further comprising a descent control mechanism for controlling the rate of descent of said enclosure after said release mechanism has released said enclosure from said cable.

14. The emergency escape apparatus of claim 13, wherein said enclosure is freely vertically movable along a guiding beam and wherein said descent control mechanism comprises a brake that engages said guiding beam.

15. The emergency escape apparatus of claim 14, wherein said descent control mechanism further comprises a speed detecting device to detect the rate at which said enclosure is descending.

16. The emergency escape apparatus of claim 15, wherein said descent control mechanism further comprises a control device that controls the application of said brake in accordance with an output signal received from said speed detecting device to maintain the rate of descent of said enclosure at approximately a predetermined safe descent rate.

17. The emergency escape apparatus of claim 12, wherein said release mechanism comprises an explosive bolt.

18. The emergency escape apparatus of claim 12 wherein said enclosure is the cab of a passenger elevator.

19. An emergency escape elevator for lowering passengers in a multistory building to an escape floor in the event of an emergency situation, said elevator comprising:

an elevator cab for holding the passengers;

a cable having a first end attached to said cab and a second end attached to a counterweight;

a driving mechanism including a motor for vertically moving said cab by raising and lowering said cable; and a release mechanism for releasing said cab from said cable to allow said enclosure to descend under the force of gravity.

* * * * *